US005493978A

United States Patent [19]

Campolucci

[11] Patent Number: 5,493,978

[45] Date of Patent: Feb. 27, 1996

[54] INDUSTRIAL SEWING MACHINE UNDER THE HEAD OF WHICH THERE IS FIXED A CROSS SHAPED TABLE TO SUPPORT THE TROLLEY WHICH TRANSPORTS A DOUBLE CLAMP

[75] Inventor: Carlo Campolucci, Corinaldo, Italy

[73] Assignee: J.A.M. -S.R.L., Italy

[21] Appl. No.: 307,505

[22] Filed: Sep. 16, 1994

[30] Foreign Application Priority Data

Sep. 21, 1993 [IT] Italy ..... AN93A0050

[51] Int. Cl.[6] ..... D05B 21/00

[52] U.S. Cl. ..... 112/470.14; 112/114; 112/311

[58] Field of Search ..... 112/104, 114, 112/113, 121.15, 121.12, 311, 470.14

[56] References Cited

U.S. PATENT DOCUMENTS 4,286,531 9/1981 Molloy ..... 112/121.15

4,406,234 9/1981 Johnson et al. ..... 112/121.15

4,602,578 7/1986 Yokoe et al. ..... 112/121.15

*Primary Examiner*—Paul C. Lewis

*Attorney, Agent, or Firm*—Leonard Bloom

[57] ABSTRACT

The instant invention concerns an industrial sewing machine of the type comprising a double clamp for gripping and transporting the patch and the fabric on the work surface, this clamp being applied to the front of a trolley, connected both to the first slide of a cross shaped table, activated by a motor by means of a toothed belt, and to the rack rod of a rack and pinion, activated by a motor; this sewing machine is characterised by the fact that the aforementioned cross shaped table is positioned above the trolley and fixed below a support plate, the support plate being below the projecting arm of the sewing machine.

1 Claim, 1 Drawing Sheet

INDUSTRIAL SEWING MACHINE UNDER THE HEAD OF WHICH THERE IS FIXED A CROSS SHAPED TABLE TO SUPPORT THE TROLLEY WHICH TRANSPORTS A DOUBLE CLAMP

FIELD OF THE INVENTION

The instant invention concerns an industrial numerically controlled sewing machine under the head of which there is fixed a cross shaped supporting table for the trolley which transports the double clamp used for the sewing of patch pockets.

DESCRIPTION OF THE PRIOR ART

In order to better underline the advantages offered by the machine according to the invention, it is considered important to briefly describe the structrural configuration and the functioning of the industrial machines currently used for the automatic sewing of patches, like for example pockets, on fabric or leather.

These special machines are fitted with a double clamp, supported and sliding along the work surface, and fixed to a trolley able to carry out movements along the axes (x and y) of a cartesian plane and namely in the left-right direction (x axis) or in the forward-backward direction (y axis).

This double clamp is made up of one plate for the clamping of the support and a second plate, which works inside the first plate, for the clamping of the patch; more precisely, the larger clamp support plate is fitted with a central window exactly the same size as the patch to be sewn.

The patch fixing plate is similar in shape to the aforementioned windows but smaller, in such a way as to be able to leave a free surrounding portion, which is used by the needle in the sewing phase.

The double clamp has two functions:

- to separately clamp the patch and the support fabric on the sewing work surface;
- to pull the patch and the support fabric along a closed curved path which coincides exactly with the sewing line to be followed.

The transport trolley, to which said double clamp is applied is connected to two distinct motorization groups, one intended to impose transversal movements in a straight line along the x axis, the other intended to impose longitudinal movements in a straight line along the y axis.

The group which enables the trolley to move in the longitudinal direction (forwards and backwards) is positioned above the work surface and comprises a rack and pinion, the rack being connected to the rack-rod. The rack and pinion is activated by a motor flanged to the bearing column of the sewing machine. More precisely, the abovementioned rack-rod protrudes from the front of this column and is fixed to the back of a transversal bracket, which supports the transversal bars used to sustain and guide the clamp-holding trolley.

The group which enables the trolley to move in the transversal direction (left-right) is positioned below the work surface and comprises a cross-shaped table, fitted with its own motorization, which provides for the use of a belt transmission, extending in the transversal direction, in order to make the cross-shaped table slide move towards the right or the left. This first cross shaped table slide, positioned below the work surface, is connected by means of a bearing arm, to the clamp-holding trolley above, positioned above the work surface.

In this way, the clamp-holding trolley is able to effect linear movements towards the right or left by means of the first cross shaped table slide, or linear movements forwards or backwards, by means of the rack-rod of the aforementioned reel-rack kinematic pair. One of the main problems with this type of special sewing machine lies in the fact that there is only a very limited amount of space available at the back of the needle to lay out the fabric on which the patch insert is to be sewn.

In the case of standard sewing machines, this space extends up to the base of the bearing column of the sewing machine, while as far as the abovementioned special sewing machines are concerned, this space cannot extend beyond the bearing arm which connects the second cross-shaped table slide to the clamp holding trolley above; said arm, even when the second slide is as far back as possible, is in any case, in a position several centimeters in front of the base of the bearing column of the sewing machine.

This reduction in the amount of space available behind the needle for laying out the fabric on which the patch is to be sewn, considerably limits the use of the machines which can only be used efficiently, that it is to say without the gathering of said fabric, if the distance between the patch to be sewn and the edge of the supporting fabric is less than the distance between the needle and the bearing arm of the first cross-shaped table slide.

Another factor which reduces the scope of the special machines currently in use for the automatic sewing of patch inserts, consists in the limited stroke of the clamp-holding trolley in the longitudinal direction, that it is to say, forwards and backwards. This limitation is mainly due to the space required for the housing of the cross shaped table underneath the work surface. In fact, the cross shaped table is housed within a space in the bearing frame of the sewing machine, which extends from the base of the bearing column of the machine to the back edge of the needle plate.

This means that the maximum stroke which the clamp holding trolley can achieve according to the (y) axis is equal to the distance between the back edge of the needle plate and the front edge of the second cross shaped table slide, when said slide is in position as far back as possible. It is obvious that the maximum length (measured in the longitudinal direction) of the seam to be sewn on the patch, depends on the maximum stroke of the second slide in the longitudinal direction (forwards-backwards).

SUMMARY OF THE INVENTION

The aim of the instant invention is to extend the scope of said special sewing machines, by increasing the stroke of the second cross-shaped table slide in the longitudinal direction (forwards-backwards) and by increasing the space available for the laying out of the fabric behind the needle.

This double result has been obtained by positioning the cross-shaped table and its motor, above the work surface.

More precisely, in the machine according to the invention, the cross-shaped table is fixed below a support plate, which is, in its turn, screwed below the swing arm of the sewing machine.

In this new machine, therefore, the connection between the clamp-holding trolley and the motorization group rack and pinion for the longitudinal movements (forwards-backwards), stays unchanged, while the connection between the clamp-holding trolley and the second cross-shaped table slide which is now above the trolley, is completely overturned 180°.

The idea of positioning the cross-shaped table above the clamp-holding trolley, leaves the work surface completely free and it can therefore be extended up to the base of the bearing column of the sewing machine. Moreover, this overturning allows the stroke of the second cross-shaped table slide to be increased in the longitudinal direction (forwards-backwards), this second slide now being able to extend its stroke forwards beyond the rear edge of the needle plate below.

In the description which follows, with reference to the attached drawings, the detailed description of the two motorization groups of the clamp-holding trolley, has been expressly omitted, in that these two groups are more or less unchanged, both from the structural and the functional point of view, when compared to the groups installed on current sewing machines. The same can be said of the cross-shaped table which, compared to the current tables is only of a larger size especially in the longitudinal direction, since it is no longer limited in size by the amount of space available underneath the work surface, where said cross-shaped table is currently housed.

For further clarity of explanation, the description of the invention continues with reference to the attached drawings, reproduced for illustrative and not limitative purposes, wherein:

DESCRIPTION OF THE PREFERRED EMBODIMENT

Figure 1:
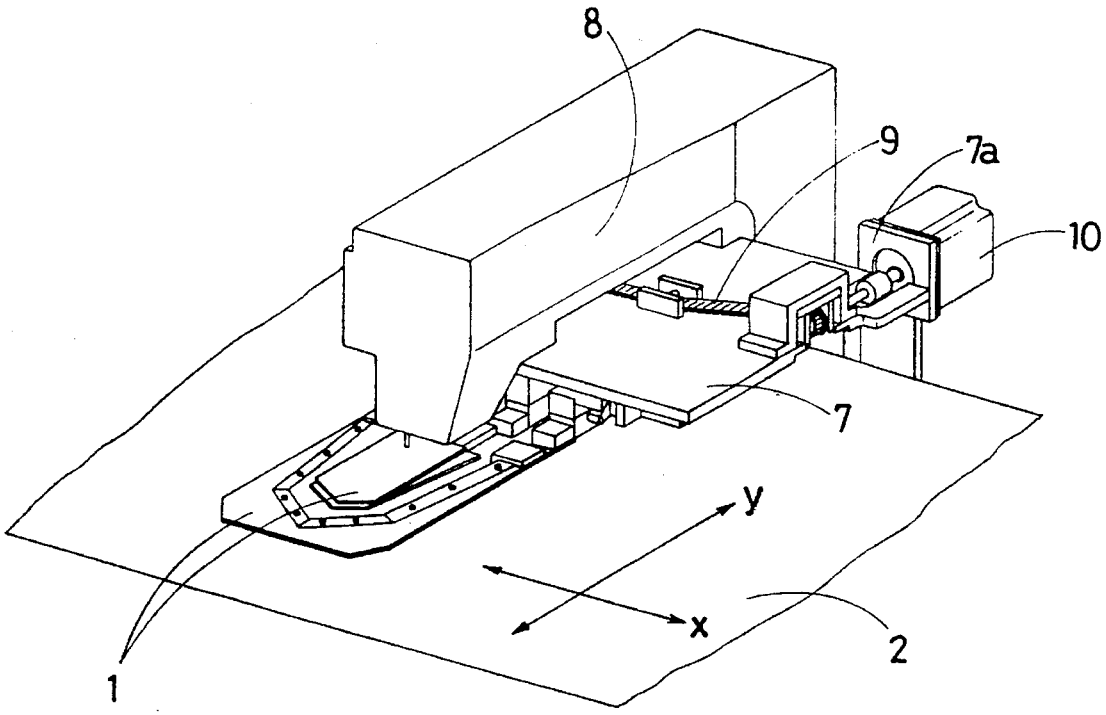
FIG. 1 is an axomometric representation of the sewing machine according to the invention.

With reference to the aforementioned figures, the sewing machine according to the invention is of the type comprising a conventional double-clamp (1) for gripping and transporting the patch and the fabric above the work surface (2).

Said double clamp (1) is applied to the front of a trolley (3), of standard structure, which is connected both to the second cross-shaped table slide (4y), and the rack rod (5) of a rack and pinion.

Said rack and pinion, which already exists in current sewing machines similar to the machine in question, is activated by a motor (6), applied to the side of the bearing column of the sewing machine.

The machine according to the invention is unique in that the cross-shaped table (4) is above the trolley (3) and is fixed below a support plate (7), in its turn screwed below the swing arm (8) of the sewing machine.

The number (9) indicates the toothed belt which pulls the first cross-shaped table slide (4x) in the transversal direction (left-right); this toothed belt is activated by a motor (10) mounted on a flange (**7*a*), on the back of the plate (7**).

An examination of the aforementioned figures underlines the advantages offered by the invention. First of all, the work surface (2) no longer has slits or openings underneath the swing arm of the sewing machine, and therefore those elements which cause surface discontinuity no longer exist; elements, which in current sewing machines are the possible cause of jamming or tearing of the fabric, which is pulled and pressed against the work surface (2) of the double clamp.

Figure 2:
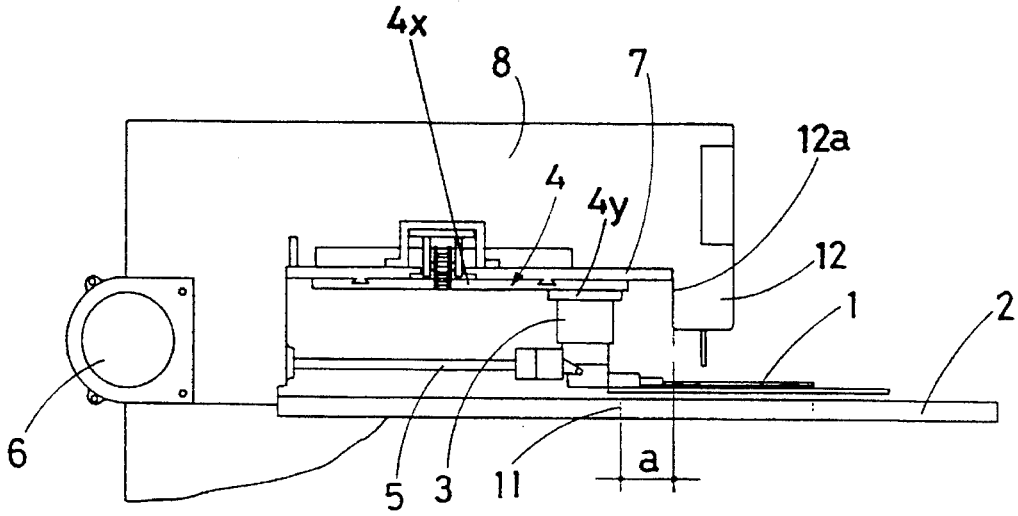
FIG. 2 is the view seen from left to right of FIG. 1.

FIG. 2 underlines the extra stroke (a) gained in the longitudinal direction due to overturning the cross-shaped table (4) 180°; as already mentioned above, this gain (a) is due to the fact that the second cross-shaped table slide (4y) can now extend its stroke forwards beyond the rear edge (11) of the needle plate, until it reaches the rear wall (**12*a*) of the sewing machine head (12**).

The invention claimed is:

1. Industrial sewing machine having a work surface, a swing arm head with an underside, a support plate attached to the underside of the swing arm head, the support plate and the swing arm head being mounted above a cross-shaped table having a first slide and second slide, a trolley having a front surface being supported beneath the cross-shaped table, a double clamp being connected to the front surface of the trolley, the double clamp gripping and transporting a patch and fabric above the work-surface of the sewing machine, the trolley with the attached double clamp being connected to the second cross-shaped table slide, the first cross-shaped table slide being connected to a toothed belt, the toothed belt being moved by a first motor, the trolley with the attached double clamp further being connected to a rack rod of a rack and pinion, the rack and pinion being mounted above the work surface and being moved by a second motor, wherein the cross-shaped table is disposed above the trolley and below the support plate on the underside of the swing arm head.

* * * * *